US005119602A

United States Patent [19]

Shemesh

[11] Patent Number: 5,119,602

[45] Date of Patent: Jun. 9, 1992

[54] PIPE FITTING REAMER

[76] Inventor: Josef Shemesh, 1538 West 59th Avenue, Vancouver, British Columbia, Canada, V6P 1Z2

[21] Appl. No.: 777,846

[22] Filed: Oct. 16, 1991

[51] Int. Cl.[5] ..... B24D 9/02

[52] U.S. Cl. ..... 51/372; 51/375; 51/392; 51/393

[58] Field of Search ..... 51/372, 375, 376, 377, 51/378, 379, 381, 382, 389, 391, 392, 393, 281 P, 290; 15/104.02, 104.03, 104.05, 104.06, 104.19, 104.09

[56] References Cited

U.S. PATENT DOCUMENTS

| | | | |
|---|---|---|---|
| 919,618 | 4/1909 | McBee . | |
| 2,469,586 | 5/1949 | Wallace | 51/379 |
| 2,734,321 | 2/1956 | Field | 51/190 |
| 2,800,750 | 7/1957 | Field | 51/375 |
| 2,801,503 | 8/1957 | Pass | 51/184.1 |
| 3,168,799 | 2/1965 | Johnson | 51/392 |

*Primary Examiner*—Bruce M. Kisliuk
*Assistant Examiner*—Eileen P. Morgan
*Attorney, Agent, or Firm*—Townsend and Townsend

[57] ABSTRACT

A tool for cleaning internal cylindrical surfaces provides for removal the abrasive particles without grinding them into the surface. The tool comprises a shank having a head at one end adjacent a square shaft portion, and a threaded portion at the other end, a deformable sleeve having a square axial hole to fit over the square shaft portion of the shank the sleeve being substantially cylindrical in shape and having at least one flat side, a flexible band, externally coated with abrasive material to fit over the sleeve, a handle member with an axial hole to receive the shank, and internal threaded member at an end of the handle member to attach to the threaded portion of the shank, to hold and compress the sleeve between the head of the shank and the handle member so the sleeve grips the flexible band.

7 Claims, 1 Drawing Sheet

PIPE FITTING REAMER

TECHNICAL FIELD

The present invention relates to the preparation of pipe fittings for solder jointing and more particularly to a tool for cleaning and abrading an internal cylindrical surface of a pipe fitting.

BACKGROUND ART

Pipe fittings, particularly those made of copper or brass, have an internal cylindrical surface into which a copper pipe is placed and joined by means of solder. It is important to clean and abrade the internal cylindrical surface of the pipe fitting, otherwise a good solder joint is not formed. The copper pipe or tube can be cleaned by means of emery cloth or the like, however it is harder to clean the internal surface of the pipe fitting, particularly in the case of a small diameter fitting. Various tools have been provided for cleaning and abrading the cylindrical surface of pipe fittings, examples include U.S. Pat. No. 2,469,586 to Wallace and U.S. Pat. No. 3,168,799 to Johnson, both of which provide hand tools having a cylindrical or frusto conical end which have abrasive surfaces and are used for cleaning the internal cylindrical surfaces of a pipe fitting or tube fitting. Whereas these devices are satisfactory it is found that the conical shaped tool is difficult to clean or abrade the very end of the internal cylindrical surface. The tool, if not handled carefully, can provide a tapered internal cylindrical surface resulting in more solder being required or the tube not being accurately aligned in the fitting. In the case of the tool having a cylindrical end, it is found that the abrasive particles together with brass or copper particles tend to fill up spaces in the abrasive surface thus causing more effort for a user to clean and abrade the surface. It also requires more continual changing of the abrasive material, be it in the form of emery cloth or the like.

It is known to provide an abrasive sheet band on the exterior of an expander member such as that shown in U.S. Pat. No. 2,801,503 to Pass. Thus by expanding the abrasive cylindrical surface one is able to adjust the diameter of the band to the internal cylindrical surface to be cleaned. However if there is no space for the abrasive particles to be removed they collect on the abrasive surface which reduces the cleaning ability of the tool.

DISCLOSURE OF INVENTION

It is an aim of the present invention to provide a tool for cleaning and abrading an internal cylindrical surface of pipe fittings and the like which provides for removal of abrasive and other particles produced during the abrading or cleaning operation without embedding them in the abrasive surface of the band. It is a further aim to provide a cleaning tool which has a deformable sleeve holding a flexible band externally coated with abrasive material wherein the deformable sleeve can be axially compressed to vary the diameter to suit specific diameters of internal cylindrical surfaces and has at least one flat side to permit abrasive material to fall out of the fitting and not be polished or ground into the abrasive surface of the flexible band.

The present invention provides a tool for cleaning and abrading internal cylindrical surfaces comprising: a shank having a head at one end adjacent a square shaft portion, and a threaded portion at the other end; a deformable sleeve having a square axial hole to fit over the square shaft portion of the shank, the sleeve being substantially cylindrical in shape and having at least one flat side; a flexible band externally coated wit abrasive material to fit over the sleeve; a handle member with an axial hole to receive the shank, and internal threaded member at an end of the handle member to attach to the threaded portion of the shank, to hold and compress the sleeve between the head of the shank and the handle member so the sleeve grips the flexible band.

BRIEF DESCRIPTION OF DRAWINGS

In drawings which illustrate embodiments of the invention

BEST MODE FOR CARRYING OUT THE INVENTION

Figure 1:
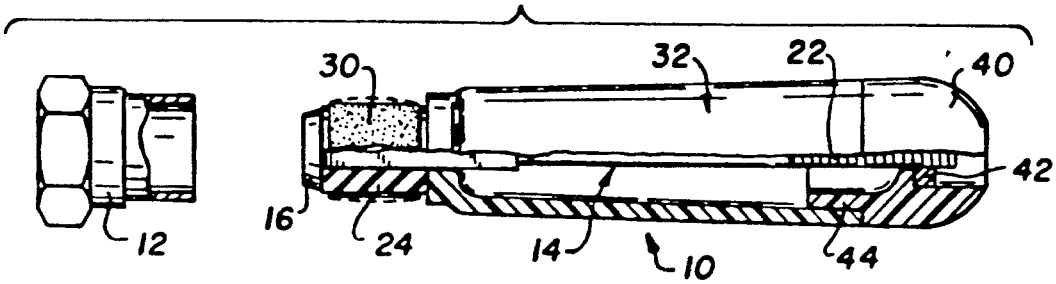
FIG. 1 is a side view, partially in section, of a tool for cleaning internal cylindrical surfaces such as a pipe fitting according to one embodiment of the present invention.
Figure 2:
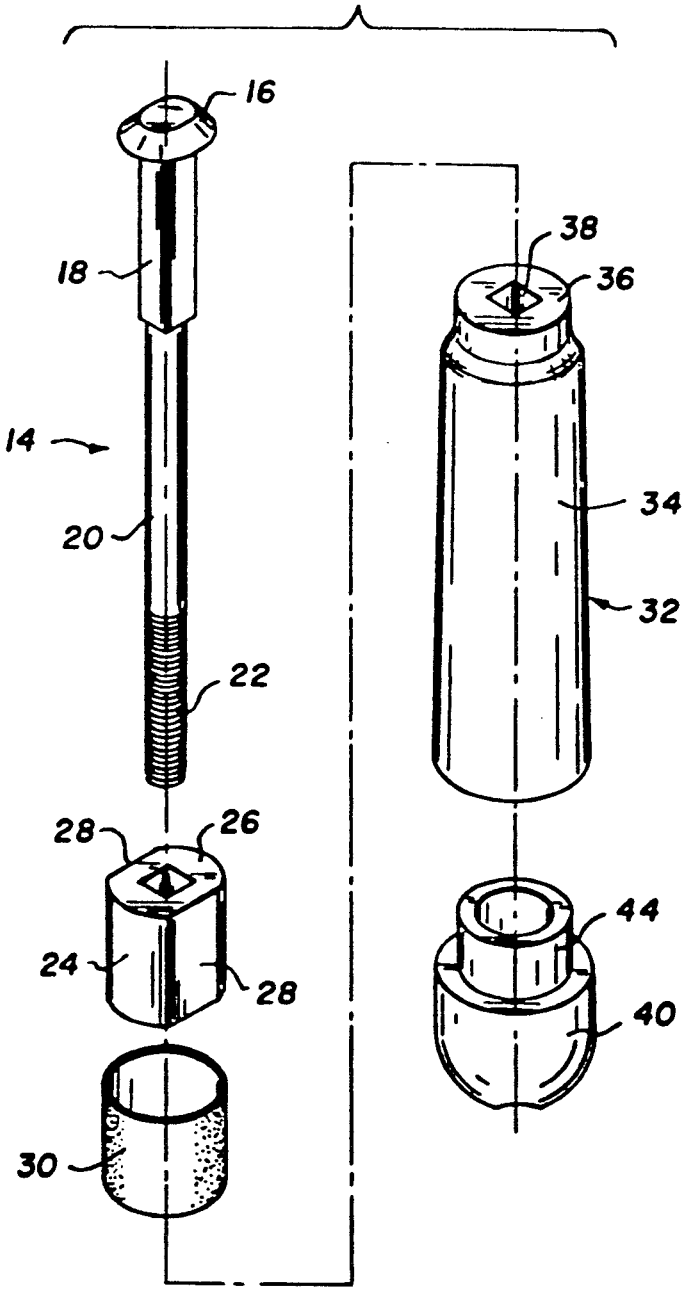
FIG. 2 is an exploded view showing the elements of the tool of FIG. 1.

Referring now to the drawings, a tool 10 for cleaning and abrading the internal cylindrical surface of a pipe fitting 12 is shown in FIG. 1 having a central shank 14 with a head 16 at one end which has a frusto-conical shape. Adjacent the head 16 is a square portion 18 which joins to a rod-like portion 20 ending in a threaded portion 22. Details of the shank 14 are shown more clearly in FIG. 2.

A deformable sleeve 24 preferably made of rubber, has a square axial hole 26 to fit over the square portion 18 of the shank 14. Opposing flat surfaces 28 are provided on the sides of the substantially cylindrical shaped deformable sleeve 24. Over the sleeve 24 fits a flexible band 30, preferably made of an emery cloth, having an abrasive surface on the outside. The band 30 may be made by having overlapping strips stuck together with a suitable adhesive. The band 30 fits over the sleeve 24 with a substantially easy fit when the sleeve 24 is not compressed axially.

A handle portion 32, which is preferably made of a hard plastic material but may be any suitable material, has a front grip portion 34 and a top shoulder 36 with a square hole 38 axially located therein. The square hole 38 fits over the square shaft portion 18 of the shank 14 thus preventing the front portion 34 of the handle 32 rotating about the shank 14. The handle 32 has a rear rotating portion 40 which has a threaded nut 42 axially located therein to fit on the threaded portion 22 of the shank 14. The rear rotating portion 40 of the handle 32 has a flange insert 44 which fits within the end of the front grip portion 34 and rotates within the front grip portion 34.

In operation, the sleeve 24 is placed on the square portion 18 of the shank 14. The front grip portion 34 of the handle 32 is then placed over the shank 14 until the square hole 38 slips over the end of the square portion 18 on the shank 14. The nut 42 in the rear rotating portion 40 of the handle 32 is then engaged with the threaded portion 22 of the shank 14 and rotated until the rear rotating portion 40 of the handle engages the front grip portion 34. When the nut 42 is reasonably loose on the threaded shaft 22 then no compression occurs on the deformable sleeve 24. A flexible band 30 is placed over the sleeve 24 and the nut 42 is tightened by means of rotating the rear rotating portion 40 of the handle 32. The sleeve 24 by being compressed axially expands and grips the band 30. The extent of expansion can be varied depending on the diameter of the internal cylindrical surface to be cleaned and abraded. An operator then grips the handle 32, inserts the sleeve 24 with the band 30 thereon into the internal cylindrical hole of a pipe fitting, and reciprocates and rotates the tool within the opening.

The front grip portion 34 of the handle 32 cannot rotate relative to the band 30. During cleaning, any material scraped from the internal cylindrical surfaces and any abrasive material that comes loose from abrasive material on the flexible band 30 does not become imbedded within the band 30 itself, but remains in a space provided between the flat surface 28 where the band 30 extends across the sleeve. If the cleaning operation is done with the pipe fitting 12 having a vertical axis then this loose material drops out at the location of the flat surfaces 28 and does not remain within the pipe fitting 12. Some variation in internal diameters can be made by rotating the rear rotating portion 40 of the handle 32 thus compressing or reducing pressure on the deformable sleeve 24. When the flexible band 30 is made from emery cloth then a certain amount of expansion of the band can occur under pressure from the deformable sleeve 24. Furthermore when it is necessary to replace the sleeve it is merely necessary to slacken off the rear rotating portion 40 with the nut 42 so that the band 30 can be slipped off the sleeve 24 and a new band 30 inserted.

Different sizes of sleeve 24 and bands 30 may be provided, however in each case the sleeve 24 has at least one flat surface 28 to permit the abrasive particles and other materials cleaned from the internal cylindrical surface of the fitting 12 to drop out and not become imbedded in the surface of the band 30 which can restrict its effectiveness.

Various changes may be made to the embodiments shown herein without departing from the scope of the present invention which is limited only by the following claims.

The embodiments of the present invention in which an exclusive property or privilege is claimed are defined as follows:

1. A tool for cleaning and abrading internal cylindrical surfaces comprising:

a shank having a head at one end adjacent a square shaft portion, and a threaded portion at the other end;

a deformable sleeve having a square axial hole to fit over the square shaft portion of the shank, the sleeve being substantially cylindrical in shape and having at least one flat said ;

a flexible band externally coated with abrasive material to fit over the sleeve;

a handle member with an axial hole to receive the shank, and internal threaded member at an end of the handle member to attach to the threaded portion of the shank to hold and compress the sleeve between the head of the shank and the handle member so the sleeve grips the flexible band.

2. The tool according to claim 1 wherein the head of the shank has a frusto conical shape.

3. The tool according to claim 1 wherein the deformable sleeve is formed of rubber.

4. The tool according to claim 1 wherein the flexible band is formed of emery cloth.

5. The tool according to claim 1 wherein the internal threaded member is enclosed within a rear portion of the handle member which rotates relative to a front portion of the handle member adjacent the sleeve.

6. The tool according to claim 5 wherein the front portion of the handle has a square axial hole to fit over the square shaft portion of the shank and prevent the front portion of the handle rotating relative to the deformable sleeve.

7. The tool according to claim 1 wherein the sleeve has two opposing flat sides.

* * * * *